US005411172A

United States Patent [19]

Brugerolle et al.

[11] Patent Number: 5,411,172

[45] Date of Patent: May 2, 1995

[54] UNITARY ASSEMBLY OF BEVERAGE KEG AND GAS RESERVOIR

[75] Inventors: Jean-Renaud Brugerolle; Alain Robin, both of Paris, France

[73] Assignee: L'Air Liquide, Societe Anonyme Pour L'Etude et L'Exploitation des Procedes Georges Claude, Paris, France

[21] Appl. No.: 169,983

[22] Filed: Dec. 16, 1993

[30] Foreign Application Priority Data

Jan. 5, 1993 [FR] France ..... 93 00036

[51] Int. Cl.[6] ..... B67D 1/04

[52] U.S. Cl. ..... 222/4; 222/399

[58] Field of Search ..... 222/4, 399, 400.7; 220/581, 522, 524, 528

[56] References Cited

U.S. PATENT DOCUMENTS

| | | | |
|---|---|---|---|
| 635,678 | 10/1899 | Eckardt | 222/399 X |
| 2,164,172 | 6/1939 | Dalton | 222/399 |
| 3,259,274 | 7/1966 | Klasson et al. | 222/48 |
| 3,561,649 | 2/1971 | Wilson | 222/399 |
| 5,209,378 | 5/1993 | Wiseburgh et al. | 222/399 X |

FOREIGN PATENT DOCUMENTS

| | | | |
|---|---|---|---|
| 8907059 | 9/1989 | Germany . | |
| 40778 | 11/1962 | Luxembourg . | |
| 28300 | of 1897 | United Kingdom | 222/399 |
| 333809 | 8/1930 | United Kingdom | 222/399 |
| 1133232 | 11/1968 | United Kingdom | 222/399 |
| 2256009 | 11/1992 | United Kingdom | 222/399 |
| 8912599 | 12/1989 | WIPO | 222/399 |

*Primary Examiner*—Andres Kashnikow
*Assistant Examiner*—Lisa Douglas
*Attorney, Agent, or Firm*—Young & Thompson

[57] ABSTRACT

Assembly of a pressurizable beverage keg (8) and a reservoir (1) of pressurization gas containing $CO_2$ and comprising an expansion valve (5). The reservoir (1) is a toric portion (2) disposed concentrically at one end of the keg (8). The expansion valve (5) is mounted on one of the ends (3) of the torus. The keg (8) has at one end a handling skirt (11) defining an internal space, and the reservoir (1) is entirely disposed in the internal space of the skirt (11). The expansion valve (5) is coaxial to its end (3) of the torus (2) and has a passage (6) for emptying and filling the reservoir (1), opening through the peripheral wall of the reservoir (1) adjacent the same end (3) of the torus.

12 Claims, 2 Drawing Sheets

UNITARY ASSEMBLY OF BEVERAGE KEG AND GAS RESERVOIR

The present invention relates to assemblies of pressurizable beverage keg and a pressurizing reservoir of gas containing $CO_2$ and comprising an expansion valve.

The withdrawal of beer of high quality, of cider or of carbonated beverages, requires the use of a pressurizing gas containing $CO_2$, particularly liquid or gaseous $CO_2$ or a $CO_2$-nitrogen mixture, which have until the present been provided in conventional gas flasks which are heavy, unstable and difficult to handle.

The present invention has for its object to provide an improved assembly overcoming the above drawbacks and greatly facilitating the task of the users.

To do this, according to the invention:

- the reservoir is mounted on the keg to constitute a unitary assembly;
- the reservoir is constituted by a torus, typically of metal, disposed substantially concentrically on one end of the keg, the expansion valve being mounted on one of the ends of the torus, preferably coaxial to this latter;
- the keg comprises, at one end, a handling skirt defining an internal space and the reservoir is disposed within the skirt.

The invention therefore relates to a unitary transportable self-contained assembly, which is compact, usable with most of conventional existing kegs and preferably not changing the dimensions of these conventional kegs, avoiding the problems of connection of different kegs to a gas bottle and thus permitting best usage of the storage space of these elements in the locations for withdrawal of the beverages.

Other characteristics and advantages of the present invention will become apparent from the following description of one embodiment, given by way of illustration but in no way limiting, with respect to the accompanying drawings, in which.

In the description which follows and in the drawings, identical or analogous elements bear the same reference numerals.

Figure 1:
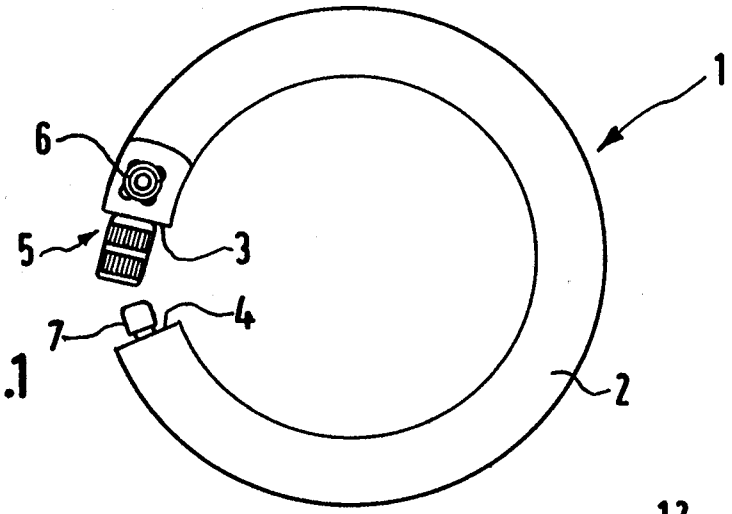
FIG. 1 is a schematic plan view of a toric gas reservoir according to the invention.

In the embodiment shown in the drawings, the reservoir 1 of pressurization gas containing $CO_2$ or a mixture of $CO_2$ and nitrogen under a pressure greater than $50\times10^5$ Pa and being adapted to reach $200\times10^5$ Pa, is constituted by a metallic tube 2, of a diameter less than 100 mm, for example of stainless steel or aluminum alloy, shaped to constitute a section of a torus whose confronting ends are closed by transverse partitions 3 and 4. In one of the partitions (3) is mounted an isolating valve/pressure reducer or expansion valve 5 of which will be seen, in the drawings, the rotatable cap for actuation and adjustment, and comprising internally an inlet/outlet passage opening laterally, at the periphery of the end of torus 2, in a connection 6 for withdrawing from and refilling reservoir 2. The expansion valve 5 is adjustable to bring the pressure of the pressurization gas of the keg to a value for example between about 3 and $10\times10^5$ Pa. In the other end wall (4) of torus 2 is disposed a safety and overpressure valve means 7 to avoid the risk of explosive overpressure in the reservoir 1 due to an overfilling or too great a temperature rise, in particular in the case of the utilization of liquid $CO_2$.

Figure 3:
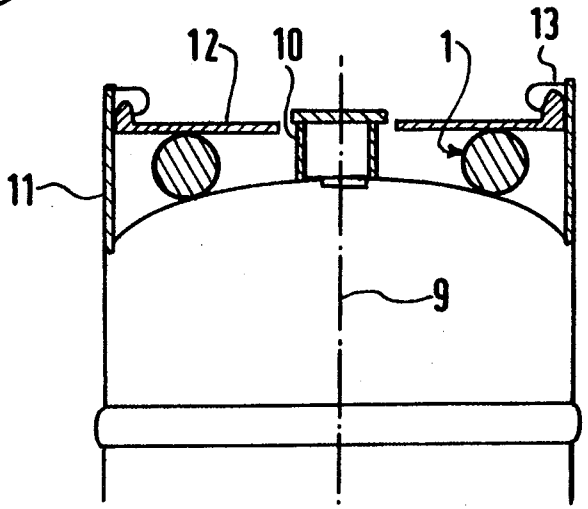
FIGS. 2 and 3 are views respectively in perspective and in longitudinal cross section of a unitary assembly according to the invention.
Figure 2:
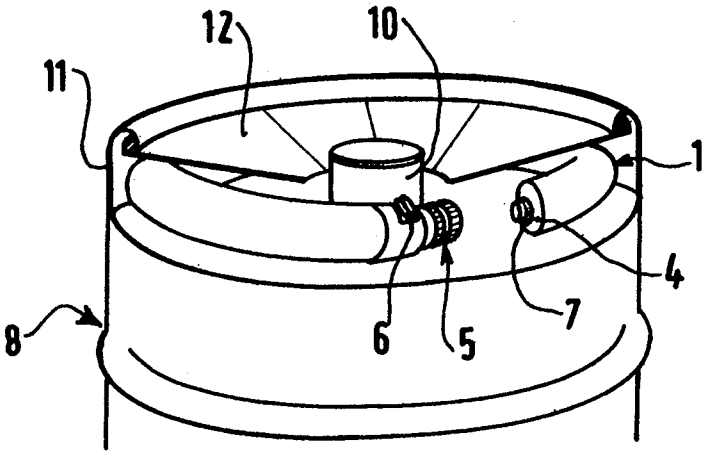

There will be seen in FIGS. 2 and 3 a conventional keg 8 for beer or carbonated beverage of cylindrical shape, with a vertical axis 9 and comprising, at its upper end, a withdrawal head 10 at the center of a peripheral protective and handling skirt 11, also called a "gallery". According to one aspect of the invention, the toric reservoir 1 is disposed in the internal space of the skirt 11, substantially concentrically to the axis 9 and is maintained within the skirt for example by an annular wall 12 comprising a cutout at the connection 6 and expansion valve 5 and maintained in place, in the illustrated example, by an insert 13 within the flange of the free end of the skirt 11. The dimensioning of reservoir 1 is preferably determined so as to contain a quantity of gas sufficient to empty the keg with which it is associated.

Figure 4:
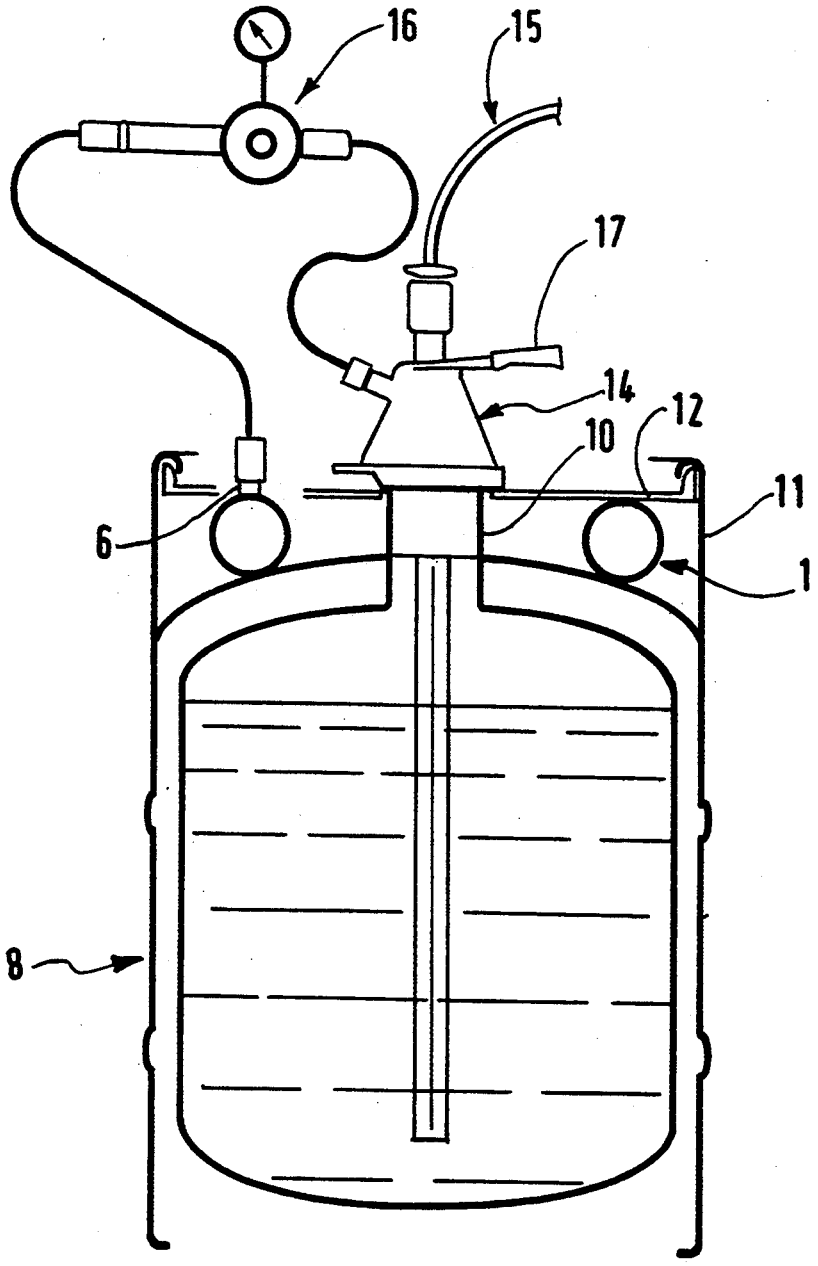
FIG. 4 is a schematic view illustrating the use of a unitary assembly according to the invention.

FIG. 4 shows the use of the unitary assembly according to the invention, under use conditions, which is to say with the keg 8 full of liquid and the reservoir 1 full of gas. The withdrawal unit 14 is placed on the withdrawal head 10, connecting the keg 8 to a withdrawal station via a distribution conduit 15. The withdrawal unit 14 is connected, via a secondary expander 16 provided with a manometer, to the outlet gas connection 6 of the reservoir 1. The isolating valve/pressure reducer or expansion valve 5 is opened, which causes expansion of gas from its storage pressure in the reservoir 1 to a reduced pressure, for example of the order of $6.5\times10^5$ Pa, which is brought to a pressure between about 1 and $3\times10^5$ Pa, according to the ambient temperature, by the expander 16 to pressurize the keg 8. The expansion valve will be further actuated until complete emptying of the keg. The handle 17 of the unit 14 is then lowered, permitting withdrawal of liquid from the keg. Another advantage of the assembly according to the invention is that the supply of secondary expansion gas from secondary expander 16 is assured no matter what the inclination of the keg.

Although the present invention has been described with respect to a particular embodiment, it is not thereby limited but is on the contrary susceptible of modifications and variations which will be apparent to one skilled in the art. Thus, the shape and the constituent material of the reservoir can be adapted to different configurations of keg, as can also the securement means and the protection means for the reservoir on the keg. Likewise, in a modification that is not illustrated, the reservoir 1 could be directly associated with a double expander with preselected pressures, directly connectable to the withdrawal unit 14.

What is claimed is:

1. The combination of a keg having a handling skirt defining an annular space and a gas reservoir housed in the annular space, the gas reservoir being in the shape of a portion of a torus having spaced apart opposite ends, a pressure regulator fitted into a first of said ends in the prolongation thereof, the pressure regulator being in fluid flow communication with an outlet connection projecting laterally from said first end.

2. The combination of claim 1, further comprising an overpressure valve means mounted in a second of said ends.

3. The combination of claim 2, wherein said first and second ends are each closed by a transverse wall in which are mounted the pressure regulator and the overpressure valve means, respectively.

4. The combination of claim 3, said pressure regulator and said overpressure valve means being spaced apart.

5. The combination of claim 1, wherein said pressure regulator has a selectable closed position of an isolating valve.

6. The combination of claim 1, further comprising protecting and holding means extending transversely across said space to protect and hold in place the reservoir in the space.

7. A gas reservoir for use with a pressurizable beverage keg, the gas reservoir comprising a metal tube shaped in the form of an arcuate portion of a torus having opposite ends each closed by an end wall, and a pressure regulator mounted in one of said end walls in fluid communication with an adjacent outlet side port of the reservoir.

8. The reservoir of claim 7, further comprising an overpressure valve fitted in the other of said end walls.

9. The reservoir of claim 7, said pressure regulator and said overpressure valve being spaced apart.

10. The reservoir of claim 7, wherein the tube has a diameter which does not exceed 100 mm.

11. The reservoir of claim 10, wherein the tube is made of stainless steel.

12. The reservoir of claim 10, wherein the tube is made of aluminum.

* * * * *